US010426999B2

(12) United States Patent
Doherty

(10) Patent No.: US 10,426,999 B2
(45) Date of Patent: Oct. 1, 2019

(54) EXERCISE EQUIPMENT FOR THE PERFORMANCE OF HAMSTRING ECCENTRIC AND CONCENTRIC EXERCISES

(71) Applicant: Noel Doherty, Co. Kilkenny (IE)

(72) Inventor: Noel Doherty, Co. Kilkenny (IE)

( * ) Notice: Subject to any disclaimer, the term of this patent is extended or adjusted under 35 U.S.C. 154(b) by 0 days.

(21) Appl. No.: 15/124,806

(22) PCT Filed: Mar. 9, 2015

(86) PCT No.: PCT/IE2015/000001
§ 371 (c)(1),
(2) Date: Sep. 9, 2016

(87) PCT Pub. No.: WO2015/136512
PCT Pub. Date: Sep. 17, 2015

(65) Prior Publication Data

US 2017/0014681 A1 Jan. 19, 2017

(30) Foreign Application Priority Data

Mar. 11, 2014 (IE) ..... 2014/0065

(51) Int. Cl.
*A63B 23/04* (2006.01)
*A63B 23/02* (2006.01)
(Continued)

(52) U.S. Cl.
CPC .... *A63B 23/0494* (2013.01); *A63B 21/00047* (2013.01); *A63B 21/068* (2013.01);
(Continued)

(58) Field of Classification Search
CPC ..... A63B 21/00047; A63B 21/0005; A63B 21/00054; A63B 21/00069;
(Continued)

(56) References Cited

U.S. PATENT DOCUMENTS 3,857,561 A 12/1974 Cecchettini et al.
4,241,915 A * 12/1980 Noble ..... A63B 21/00047 482/140

(Continued)

FOREIGN PATENT DOCUMENTS

DE 3533481 A1 3/1987
FR 2205349 5/1973

OTHER PUBLICATIONS

Borras, G., International Application No. PCT/IE2015/000001, International Search Report and Written Opinion, dated Jun. 11, 2015, 8 pages.

(Continued)

*Primary Examiner* — Gary D Urbiel Goldner
(74) *Attorney, Agent, or Firm* — LaBatt, LLC

(57) ABSTRACT

The present invention is an inclined apparatus for undertaking exercises for hamstring eccentric and concentric loading and in particular, but not limited to, exercises such as a Nordic Hamstring Exercise, a Russian Hamstring Exercise, and Russian curls. The inclined apparatus can be utilized for sports training and preparation, injury recovery and rehabilitation, and injury prevention. A main body of the inclined apparatus is so inclined as to ensure that a user does not hyperextend their knee and cause additional injury. A height of the higher end of the inclined apparatus above ground level in conjunction with leg restraints enables avoidance of collateral injuries which may occur when undertaking an exercise regime in a traditional form of dorsiflexion, plantarflexion, and laterally in either direction.

18 Claims, 8 Drawing Sheets

(51) Int. Cl.
*A63B 21/00* (2006.01)
*A63B 21/068* (2006.01)
*A63B 23/12* (2006.01)

(52) U.S. Cl.
CPC ..... *A63B 21/4029* (2015.10); *A63B 23/1236* (2013.01); *A63B 2210/50* (2013.01); *A63B 2225/09* (2013.01); *A63B 2225/093* (2013.01)

(58) Field of Classification Search
CPC ..... A63B 21/00072; A63B 21/00178; A63B 21/00185; A63B 21/002; A63B 21/0023; A63B 21/068; A63B 21/15; A63B 21/159; A63B 21/4011; A63B 21/4013; A63B 21/4015; A63B 21/4027; A63B 21/4029; A63B 21/4033; A63B 21/4034; A63B 21/4039; A63B 23/02; A63B 23/0205; A63B 23/0211; A63B 23/0216; A63B 23/0222; A63B 23/0227; A63B 23/0233; A63B 23/035; A63B 23/03516; A63B 23/03525; A63B 23/04; A63B 23/0405; A63B 23/0482; A63B 23/0494; A63B 23/08; A63B 23/12; A63B 23/1209; A63B 23/1236; A63B 23/1245; A63B 23/1281; A63B 2023/006; A63B 26/00; A63B 26/003; A63B 69/0057; A63B 69/0059; A63B 69/0064; A63B 2069/0062; A63B 71/02; A63B 71/023; A63B 2071/026; A63B 2071/027; A63B 2208/02; A63B 2208/0214; A63B 2208/0219; A63B 2208/0242; A63B 2208/0247; A63B 2208/0257; A63B 2208/0261; A63B 2208/0295; A63B 2210/00; A63B 2210/50; A63B 2225/09; A63B 2225/093
See application file for complete search history.

(56) References Cited

U.S. PATENT DOCUMENTS 5,125,884 A * 6/1992 Weber ..... A63B 21/4029 482/142
5,176,603 A * 1/1993 Hundley ..... A63B 23/0211 482/140
5,190,513 A * 3/1993 Habing ..... A63B 23/0211 482/140
D339,617 S * 9/1993 Harashima ..... D21/690
5,308,306 A 5/1994 Wang
D370,506 S * 6/1996 Clem ..... D21/687
5,839,998 A * 11/1998 Wilkinson ..... A63B 21/151 482/123
5,938,571 A * 8/1999 Stevens ..... A63B 21/068 482/135
5,997,450 A * 12/1999 Wilkinson ..... A63B 23/0211 482/121
6,123,653 A * 9/2000 Huang ..... A63B 23/0211 482/140
D541,357 S * 4/2007 Webber ..... D21/690
D541,358 S * 4/2007 Webber ..... D21/690
D541,893 S * 5/2007 Webber ..... D21/690
D542,868 S * 5/2007 Webber ..... D21/690
7,662,077 B1 2/2010 Liu
2003/0109363 A1* 6/2003 Chen ..... A63B 23/0211 482/142
2005/0003938 A1* 1/2005 Henderson ..... A63B 21/068 482/143
2006/0217249 A1 9/2006 Webber
2007/0087915 A1* 4/2007 Carattoni ..... A63B 21/068 482/95
2007/0155602 A1* 7/2007 Huls ..... A63B 21/00181 482/140
2008/0200317 A1* 8/2008 Campanaro ..... A63B 21/068 482/140
2009/0305856 A1* 12/2009 Pandozy ..... A63B 23/0211 482/140
2010/0255968 A1* 10/2010 Jiang ..... A63B 23/0211 482/140
2011/0319237 A1 12/2011 Jones et al.
2012/0122637 A1* 5/2012 Bathey ..... A63B 21/068 482/142
2014/0066276 A1* 3/2014 Hornback ..... A63B 21/068 482/145
2014/0194260 A1* 7/2014 Campanaro ..... A63B 21/068 482/131
2015/0246263 A1* 9/2015 Campanaro ..... A63B 23/03566 482/52

OTHER PUBLICATIONS

Payne, Dr. K, UK Application No. GB1503935.7, Search Report under Section 17, dated Nov. 19, 2015, 1 page.

* cited by examiner

α

FigSa

EXERCISE EQUIPMENT FOR THE PERFORMANCE OF HAMSTRING ECCENTRIC AND CONCENTRIC EXERCISES

FIELD OF INVENTION

The present invention relates to an apparatus for undertaking exercises for hamstring eccentric and concentric loading and in particular, but not limited to, exercises such as the Nordic Hamstring Exercise, the Russian Hamstring Exercise, Russian curs, and it also has applications for gluteal and hamstring raises. The apparatus can be utilised for sports training and preparation, injury recovery and rehabilitation, injury prevention and is also applicable for keep fit and for body toning.

Eccentric and concentric exercises not only have a part to play in rehabilitation from injuries, but also to prevent hamstring injuries and other injuries from occurring in the first place.

In muscular exercise there are three main types of muscle contraction. These contractions are concentric, eccentric and isometric. Concentric contraction is where the muscle is contracted, i.e. lifting a dumbbell, doing bench presses or arm or leg curts of many varieties. Eccentric contraction is the lengthening or stretching of a muscle and examples of this type of movement are lowering of the dumbbell or the lowering of the leg in a leg curl. The final type of muscular contraction is isometric, in this form of muscle usage there is no actual change in muscle length while the muscle is contracting, examples of when this occurs is when pushing against a wall or in the pause between eccentrics and concentric phases.

There are a large variety of training programmes and methodologies available and varying coaching professionals and conditioning specialists use a variety of methodologies to eccentrically load in an attempt to improve performance and prevent injury. There is a large amount of investigative work which demonstrates how specific eccentric programmes can significantly reduce hamstring injuries and rehabilitate tendonitis. Eccentric contractions are also an essential element in the improvement of explosive power and elasticity which are core elements of sports and activities which require running and jumping. Eccentric muscle training creates a more solid muscle which acts as protection to the hamstring and in addition increases the amount of elastic energy available in the shortening cycle, as a form of contraction it creates greater force with the use of less energy than a concentric contraction.

The use of eccentric training will provide greater protection from injury and re-injury for athletes undertaking these forms of exercises. Eccentric contraction exercise also benefits in the treatment of Achilles tendonitis and as a form of exercise and recovery is a viable alternative in some instances to surgical intervention. There are in addition significant benefits to patients recovering from cruciate ligament injuries specifically anterior cruciate ligament injuries.

The hamstring muscle function can be broken down into two main areas of functionality, these are initially when the leg hits the ground, they are the body's shock absorber and when the leg pushes away from the body they act as springs as they lengthen and provide enough energy to produce the thrust away from where the foot is placed. The prevalence of injuries to the hamstring occurs in greatest frequency in sports which involve bursts of speed for sprinting. The majority of these injuries occur during the final phase of the lengthening of the hamstring when the knees are being pumped high leading to the hamstring in colloquial terms being referred to as having been "pulled" as to the injured party it appears that they have pulled it or stretched it too far. This sensation is also felt when attempting to slow down or cease the run as your hamstring is absorbing all the energy of that effort.

Once a hamstring injury has occurred, the probability of re-occurrence and the persons' susceptibility to this form of injury is dramatically increased because of the formation of fibrous adhesions which have not healed properly. These adhesions accumulate due to inactivity, inflammation and overtraining and in addition to too many hard sessions in close proximity lead the hamstring to be weaker or to have a weakness. The combination of these adhesions and the weakness of the hamstring will be evident when the person wishes to increase their stride to the length they perceive they can or must and the hamstring is too weak to accommodate the requirement leading to a feeling of "tight" hamstrings and a feeling of weakness and achiness in the area. A common reaction to this is to have a day of rest or several days of rest which do not in fact assist as the muscle is not at the level of strength required for the effort required.

The response to this is to pre habilitate (PREHAB) the injury with exercises and drills to prevent the injuries or if already injured to rehabilitate (REHAB) through a corresponding exercise programme. In this area eccentric loading is both used in the preventative exercises and the recovery exercises as the best targeted response to ensure the best results to both stages.

BACKGROUND

Traditionally, the two main exercises used in response which focus on eccentric loading in prehab and rehab are the Nordic Hamstring Exercise/Russian Hamstring Exercise and Seated Single leg curs. At present the lower impact simpler exercise to perform is the seated single leg curl as it does not require a partner and the repetition of the exercise can be undertaken without risk of additional injury which can occur from the assisted Nordic Hamstring exercise. The seated leg curly involves using a specific piece of gym equipment into which the person sits and sets the weight or resistance and begins by extending and then returning the leg against a pivoted weight. While this exercise is quite controlled it does however, require a large expensive piece of specialist machinery.

The Nordic hamstring exercise is performed by kneeling with your feet side by side and held fixed in place by a partner, the person undertaking the exercise crosses their arms across their chest or lets their arms hang by their sides and lowers their body slowly towards the ground ensuring they keep a straight line from their shoulder to their knee. They extend slowly to the point of failure i.e. they lean forward and resist a falling motion using their hamstrings for as long as possible, as they progress they hold for 3-6 seconds then drop to the ground using their hands to break the fall. Return at your case to the start position and repeat. This traditional process has the risk of causing additional injury to the participant of the exercise through planterflexion or dorsiflexion, i.e. the bending of the foot too far back towards the gluteals or too far forward towards the shin or indeed inversion or eversion movements, in either direction. This risk exists because the force being exerted by the partner is uncontrolled and differs from person to person and will increase throughout the movement as the anchor person reacts to the increasing load being exerted depending on the phase of movement the person undertaking the test s currently in.

This apparatus overcomes these issues with the traditional methods in that it removes the need for a partner to assist in the undertaking of the exercise and therefore the risks that that person brought to the exercise of inducing dorsiflexion or plantarflexion. The apparatus also enables participants to undertake the exercise regime without assistance thereby making it easier for the regime to be followed.

The exercise aid can also be used for concentric exercises whereby the user can return from the lowered position using their hamstrings. This is carried out with the user in a press up position, with their feet firmly fixed in place with the foot anchor, the knees on the kneeing pad, performing an explosive push up and lifts themselves back to the upright position using their hamstrings.

STATEMENT OF INVENTION

Accordingly, the invention provides for an exercise apparatus for the performance of hamstring eccentrics and/or concentric comprising:

- a kneeling pad which is inclined along its length,
- a foot anchor positioned at the upper end of the kneeling pad, and
- a frame for supporting the kneeling pad in its inclined position and the foot anchor.

The kneeling pad is of sufficient length to accommodate the lower legs of a user from the knee to the ankle. The pad is cushioned for the comfort of the user.

The foot anchor, which is positioned at the upper end of the kneeling pad comprises a T-piece wherein a substantially horizontal length sits above a vertical member centrally positioned and extending downwards to the frame, the horizontal component is cushioned substantially along its length to accommodate the back of the user's ankles and has cushioning to protect the user's Achilles tendons. The foot anchor may be unitary with the frame or may be linked to the frame in such a manner as to allow height adjustability with respect to the kneeling pad.

The frame which is made of a durable material for example, tubular or box steel, supports the kneeling pad, the weight of the user and the foot anchor, the frame may be unitary or made from components which allow for height or length adjustment.

In one embodiment the upper face of the device presenting to the user is tilted between 5° to 20°.

In a preferred embodiment, the main support spar is tilted at between 8° and 12°.

In a more preferred embodiment the main support spar is tilted at 10.

In one embodiment the frame extends substantially beyond the lower extremity of the kneeling pad.

In another embodiment the frame is length adjustable.

In another embodiment the frame is height adjustable.

In a different embodiment the frame is collapsible for ease of storage or transport.

In one embodiment the frame comprises lengths of tubular steel curved so as to provide two upper and two lower legs.

In a different embodiment the frame comprises a main support spar running centrally the length of the apparatus with an extended horizontal bar substantially perpendicular to the main spar attached at its centre to one end of the main spar, an extended vertical bar, substantially perpendicular both to the main spar and to the horizontal bar, attached to the other end of the main spar somewhere along its length so as to fix the main spar in an inclined position, the upper end of the vertical bar being attached to the foot anchor, and the vertical bar itself having a horizontal bar attached to its lower end, the two horizontal bars providing a stable platform for the apparatus.

In a further embodiment side bars extend from the main spar to provide a platform specifically for the kneeling pad.

In one embodiment the feet of the apparatus have high grip surfaces to ensure the stability of the apparatus in use on any floor.

The apparatus is manufactured from suitably durable material to support the weight of any user while retaining a centre of gravity which resides within the foot print of the apparatus. As such, tubular metal such as steel or aluminium may be used but other materials such as wood or reinforced plastic may also be envisaged.

The advantages that the device has are that it allows the participant to undertake the exercise regime for eccentric and/or concentric workouts of the hamstring and gluteats without assistance from a third party; it is also lightweight and economical in sire facilitating movement, transportation and storage. The device also has an adjustable leg restraint which facilitates a variety of sizes and shapes of user, ensuring that their legs are restrained appropriately. The main body of the device is so inclined as to ensure that the user does not hyperextend their knee and cause injury. The height of the upper end of the device above ground level in conjunction with the leg restraints means that collateral injuries which may otherwise occur when undertaking this exercise regime in the traditional form of dorsiflexion and planterflexion are avoided and thus the great advantages of this form of preventative and rehabilitative exercise are highlighted to their full potential to a greater number of people in a wider variety of situations and the disadvantages and risks previously associated with this form of exercise are ameliorated.

The apparatus is raised from the ground and inclined from the higher point with a floor/leg/ankle anchor, to hold the leg in the place; this anchor is adjustable and therefore allows for a variation in the sizes of people who can undertake the exercise. The anchor is also cushioned to ensure no injury whilst utilising the device. The fact that the higher end of the device is raised from the floor ensures that the foot is allowed to hang comfortably in place and the overall shape and position of the foot ensures no risk of planterflexion or dorsiflexion. The device inclines from the higher end to facilitate the proper positioning of the body for hamstring eccentrics not only allowing the person to undertake the exercise but also ensuring that through the body positioning that they cannot hyperextend their knee, in addition to the benefits regarding planterflexion or dorsiflexion already outlined.

BRIEF DESCRIPTION OF THE DRAWINGS

The invention will be more dearly understood from the following description of an embodiment thereof, given by way of example only, with reference to the accompanying drawings, in which:

FIG. 3*a* shows a side elevation of the device, clearly showing the degree of inclination a.

FIG. 5*a* shows a side elevation of this embodiment of the invention, where the device is supported by two parallel tubular spars, also clearly showing the degree of inclination of the device, α.

DETAILED DESCRIPTION

Figure 1:
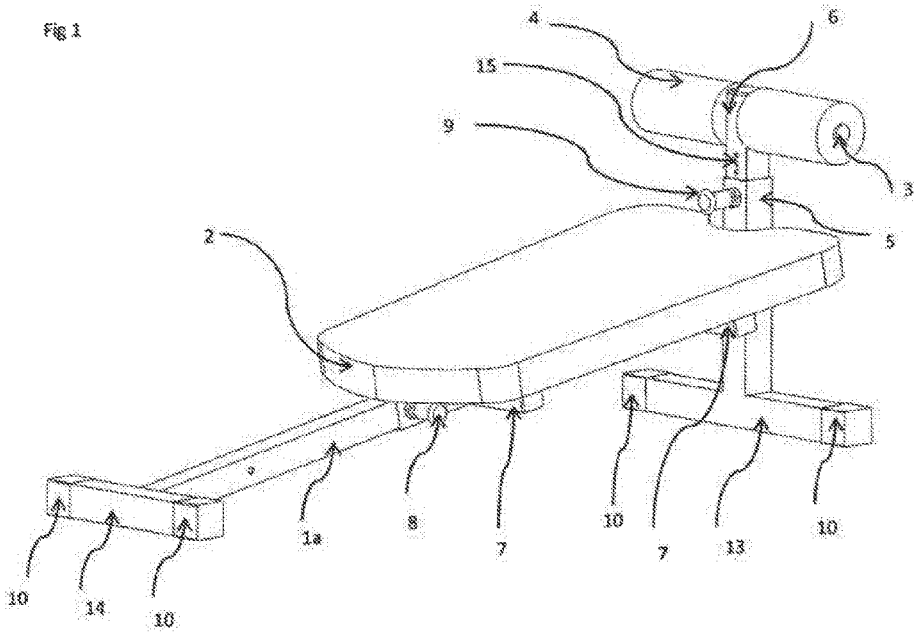
FIG. 1 shows a 3 dimensional view of an embodiment of an invention in which a main central spar provides the main support for the device
Figure 2:
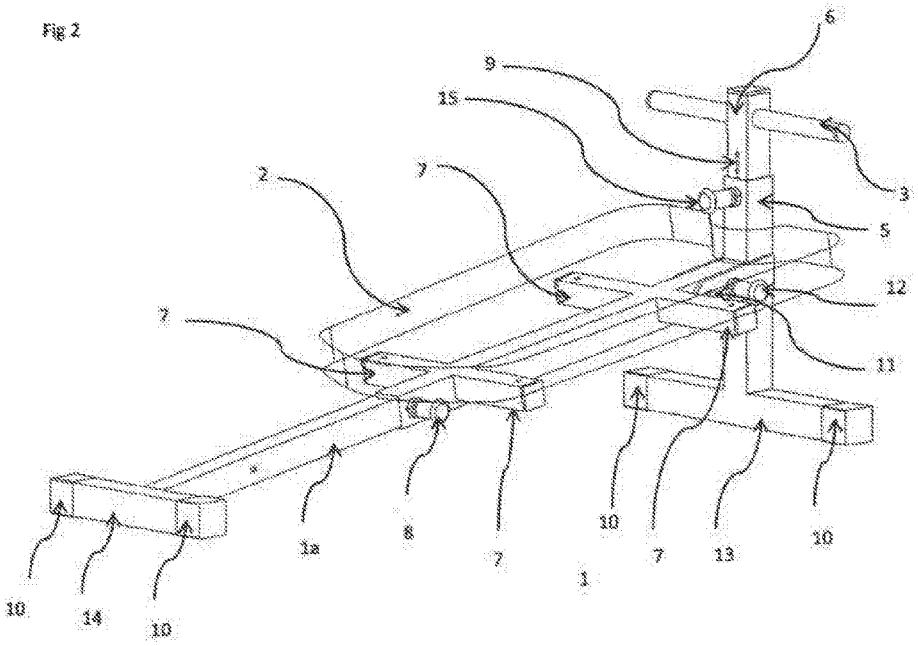
FIG. 2 shows a 3 dimensional view of the same embodiment wherein the kneeling pad has been rendered transparent for clarity, and the ankle cushions have been removed.
Figure 3:
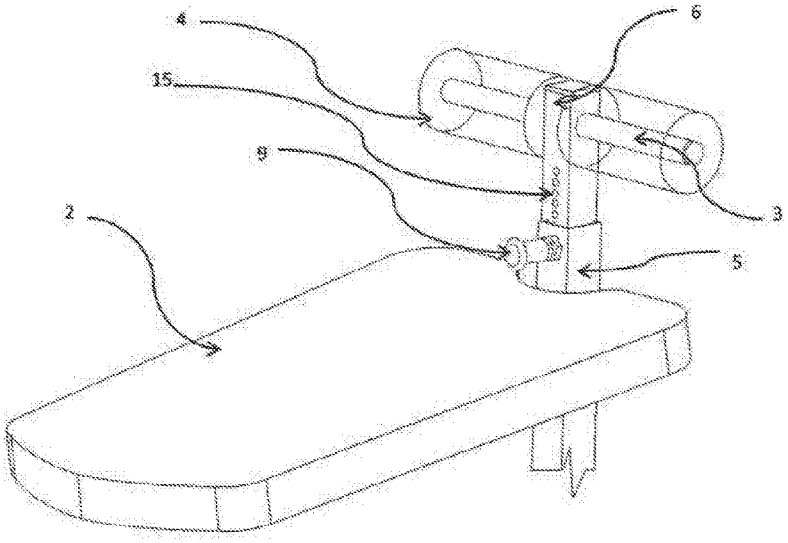
FIG. 3 shows a 3 dimensional view of the upper portion of the device indicating the adjustability in height of the ankle restraints.

Referring now to the drawings and specifically FIGS. 1 and 2 an embodiment of the invention is illustrated in a 3 dimensional view. This embodiment comprises in a main central support spar (1), which is attached to a smaller substantially vertical spar (5). Flat spars at either end of the frame (13 and 14) provide stability to the frame. The ends of each flat spar may be coated with a high grip material (10) to ensure stability of the apparatus in use. A kneeling pad (2) sits at the upper end of the main centre spar. The pad is supported by side spars (7) projecting from either side of the central main spar. Referring to FIG. 3, an upper spar (6) sits telescopically in the upper end of the vertical spar (5) and to which are attached two side spars (3) which are sheathed with cylindrical cushions (4), thereby providing ankle restraints. A quick release bolt (9) in the main vertical spar (5) combined with complementary holes (15) in the inner spar (6) facilitate the height adjustability of the ankle restraints with respect to the kneeling pad. Optionally, the vertical spar itself may be height adjustable so as to alter the angle, α, the main spar makes with respect to the horizontal.

Figure 4A:
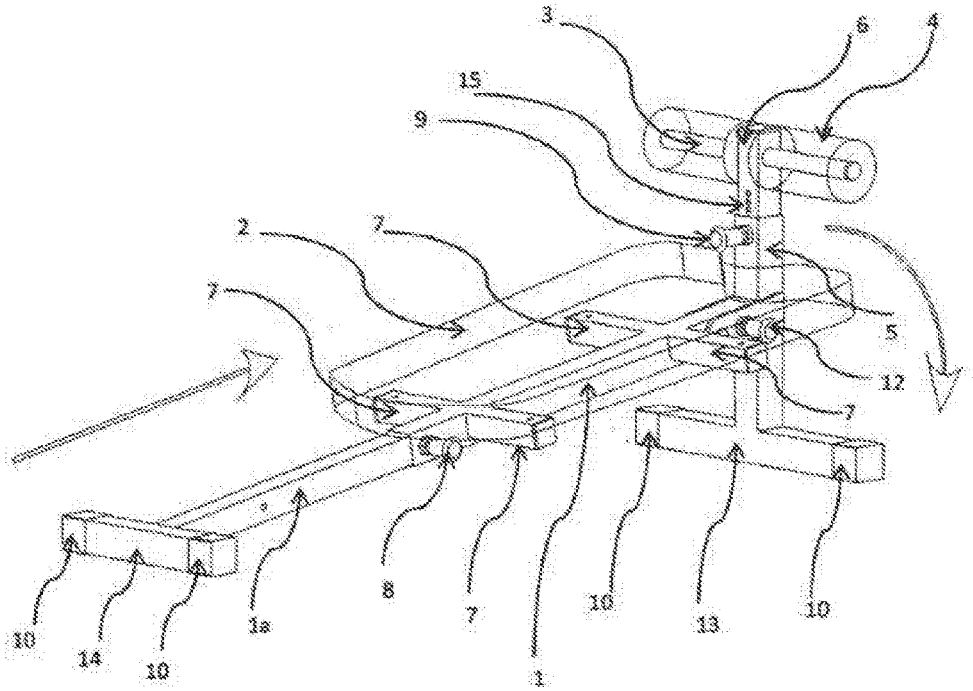
FIGS. 4*a* and *b* shows a stripped frame of the device (a) indicating how it may be compacted for storing and (b) shows the device compacted.
Figure 4B:
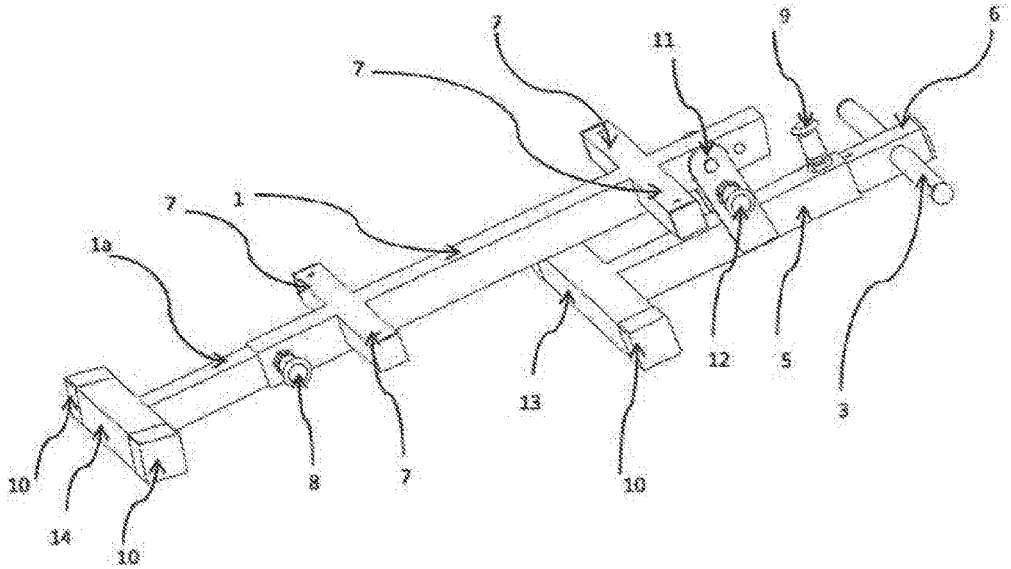

Referring now to FIG. 4, there is depicted a 3 dimensional view of a stripped frame according to a preferred embodiment (FIG. 4*a*). In this embodiment, optionally the main central spar may be formed from two lengths one of which fits telescopically into the other so as to allow length adjustability of the main spar for either convenience of use or storage. Also optionally, the vertical spar (5) may be affixed to the main spar (1) by means of a permanent hinge (11) and a releasable bolt (12), thereby allowing the apparatus to be stored more compactly (FIG. 4*b*).

Figure S shows a different embodiment of the invention, in this embodiment main support is provided by a pair of curved parallel bars (101). Spars (107) running between the two curved bars provide stability to the frame and support for the kneeling pad (2). The ends of the main spars are curved to provide feet (110) which may be coated with high grip material. A vertical spar (105) is attached to the uppermost of the cross spars (107) to provide a means of attachment for the ankle restraints, which are as described above.

Figure 6:
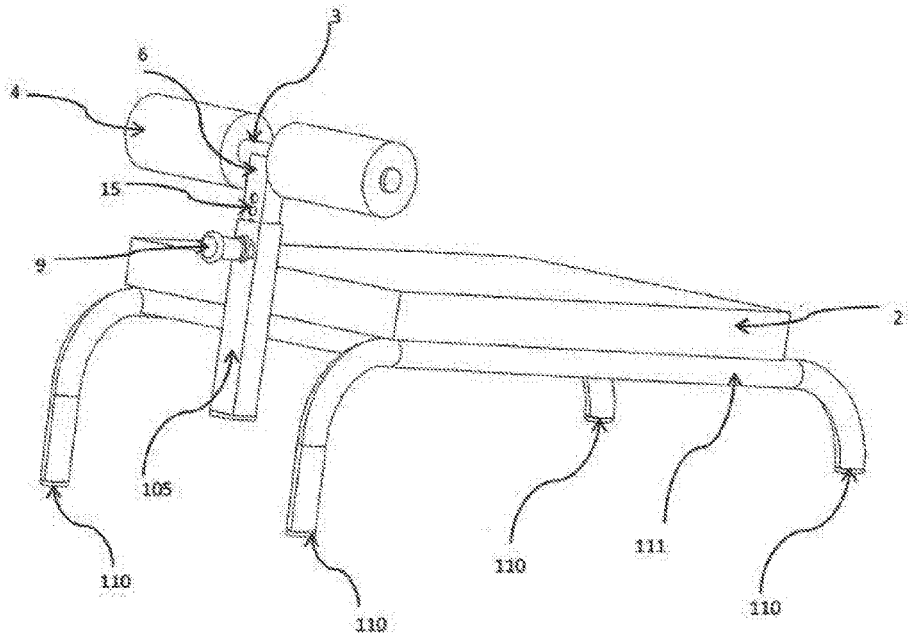
FIG. 6 shows a 3 dimensional view of a variant of the embodiment in FIG. 5 where in the support spars are shorter.

Referring to FIG. 6, in another similar embodiment the main support spars (111) may be shorter for ease of transport.

Figure 7:
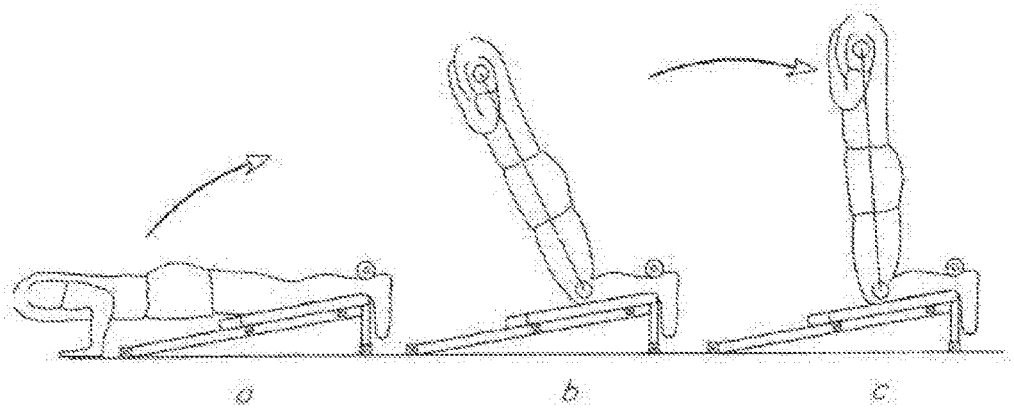
FIGS. 7*a, b* and *c* shows the sequence for performing concentric hamstring exercises.
Figure 8:
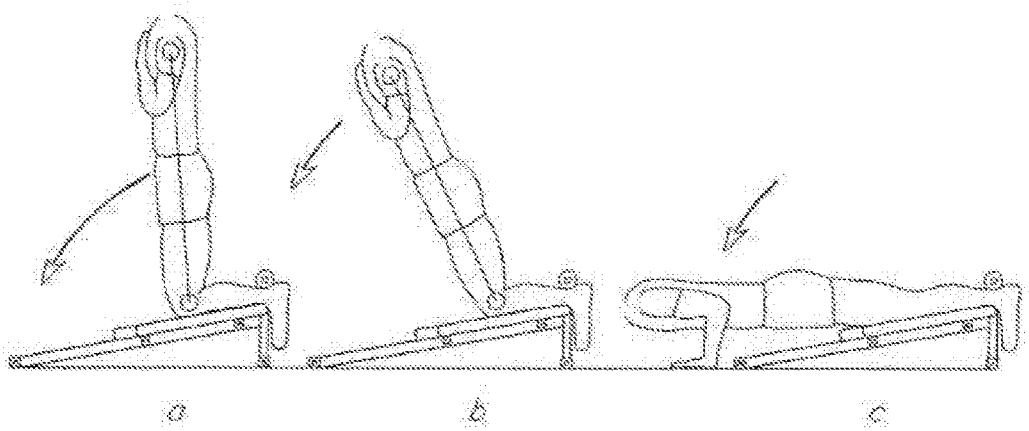
FIGS. 8*a, b* and *c* shows the sequence for performing eccentric hamstring exercises.

FIGS. 7 and 8 indicate how concentric and eccentric exercise may be performed on the apparatus discussed above. It should be noted that the apparatus according to FIG. 6 is not suitable for concentric exercise, unless the les beneath the ankle restraints are fixed to the ground. This is because concentric exercises require an apparatus with a centre of gravity in use which is further from the ankle restraints than is the case for eccentric exercises.

Figure 3A:
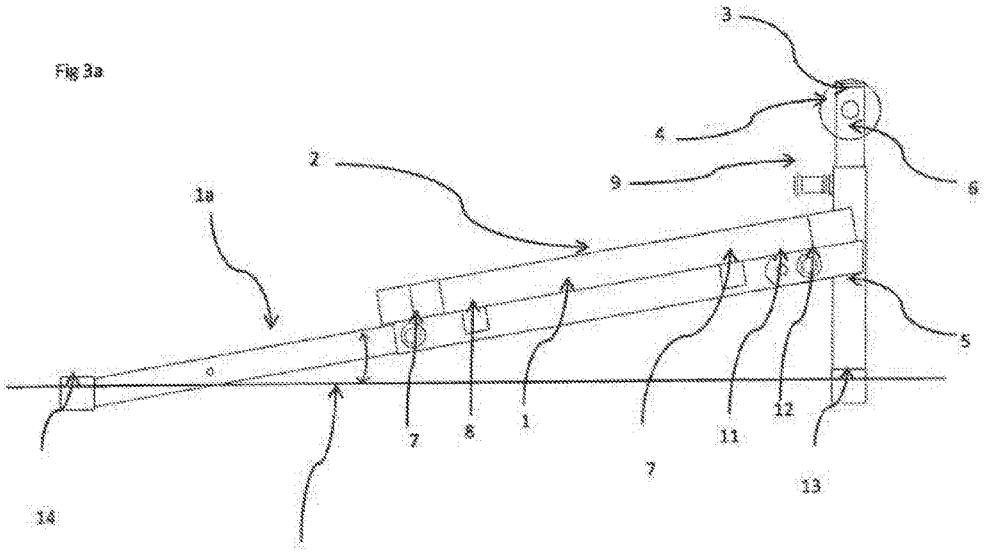
Figure 5:
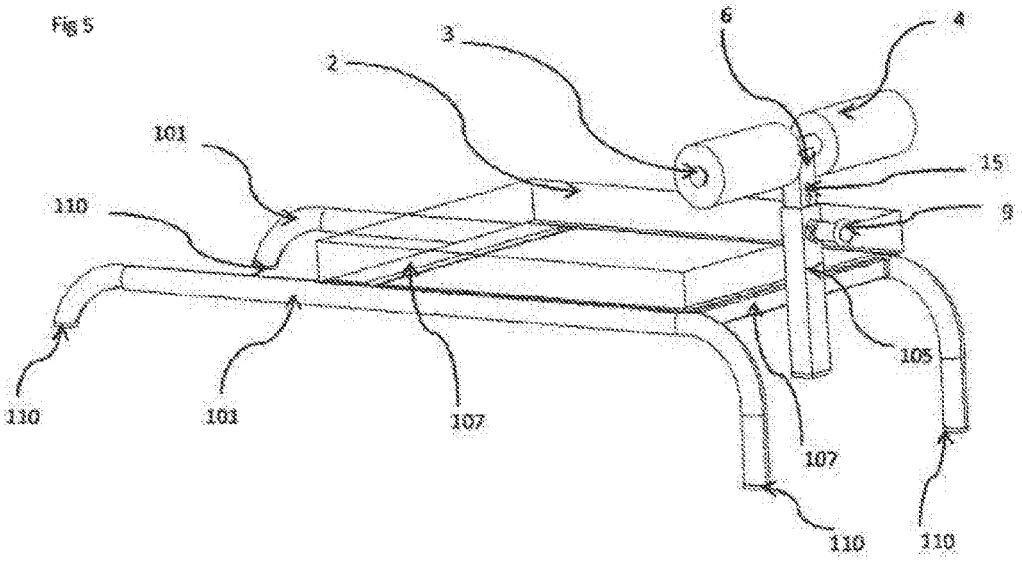
FIG. 5 shows a 3 dimensional view of another embodiment of the invention wherein the device is supported by two parallel curved tubular spars.
Figure 5:
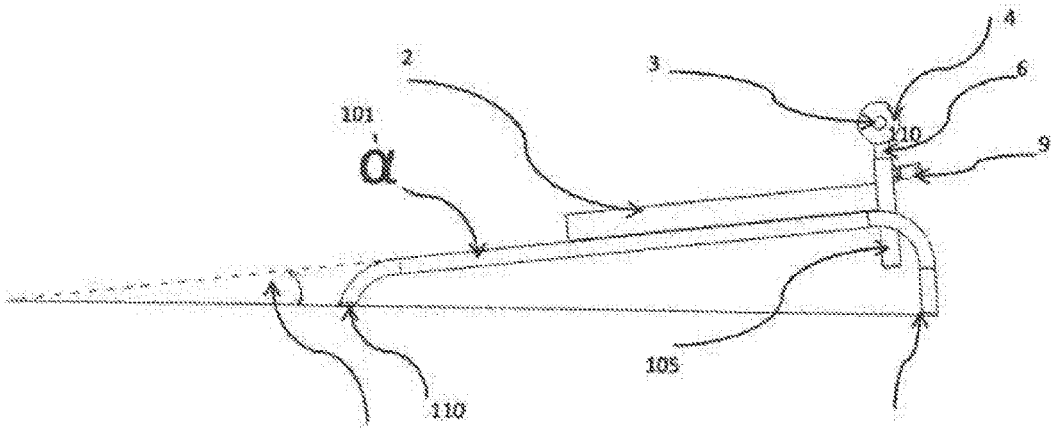

All embodiments of the invention are characterised by the main frame defining an angle, α, with respect to the horizontal. For concentric and eccentric hamstring exercises, this is necessary to ensure that there is no risk of hyperextension of the knee. This angle may range between 5' and 20°. Preferably the angle should be set at between 8° and 12°. More preferably, an angle of 10° is used. For other forms of exercise, a may be set to a different angle, depending on the nature of the exercise to be performed. For clarity, the angle, α, is indicated for two different embodiments of the invention in FIGS. 3*a* and 5*a*.

In use, the apparatus is subject to a certain degree of strain and a shifting centre of gravity. Accordingly, the apparatus is manufactured from suitably durable material to support the weight of any user while retaining a centre of gravity which resides within the foot print of the apparatus. As such, while tubular metal such as steel or aluminium may be preferred, other materials such as wood or reinforced plastic may also be envisaged.

The invention claimed is:

1. An exercise apparatus for a performance of hamstring eccentric and/or concentric exercises, the exercise apparatus comprising:

i. a collapsible frame comprising: a main support bar running centrally to a length of the exercise apparatus; an extended horizontal bar substantially perpendicular to the main support bar attached at a center thereof to a lower end of the main support bar; and an extended vertical bar, substantially perpendicular both to the main support bar and to the extended horizontal bar, attached at a location along a length thereof to an upper end of the main support bar, so as to fix the main support bar in position, the extended vertical bar having a horizontal bar attached perpendicularly to a lower end thereof, such that, in combination with the extended horizontal bar at the lower end of the main support bar, a stable platform for the exercise apparatus is formed;

ii. a kneeling pad fixed to an upper surface of the main support bar, the kneeling pad configured to be of sufficient length to accommodate lower legs of a user from the user's knees to the user's ankles; and iii. a foot anchor attached to an upper end of the extended vertical bar, proximal to an upper end of the kneeling pad, the foot anchor mounted above the kneeling pad and configured to maintain the lower legs of the user, from the user's knees to the user's ankles, against an upper face of the kneeling pad when the user performs the hamstring eccentric and/or concentric exercises, the foot anchor being linked to the collapsible frame in such a manner as to allow it to be height adjusted with respect to the kneeling pad;

wherein the main support bar is fixable in an inclined position with respect to a surface on which the exercise apparatus rests; and wherein, when the exercise apparatus rests on the stable platform, the upper face of the kneeling pad is inclined between 5 degrees and 20 degrees with respect to a horizontal orientation relative to the surface, the extended vertical bar is adjacent to the kneeling pad, and the upper end of the extended vertical bar is spaced a vertical distance above the upper face of the kneeling pad.

2. The exercise apparatus according to claim 1, wherein the upper face of the kneeling pad is inclined between 8 degrees and 12 degrees with respect to the horizontal orientation relative to the surface.

3. The exercise apparatus according to claim 1, wherein the kneeling pad is cushioned for comfort of a user.

4. The exercise apparatus according to claim 1, wherein the foot anchor comprises a T-piece wherein a substantially horizontal component thereof is centrally positioned above, and perpendicular to, a vertical member thereof extending downwards to the extended vertical bar of the collapsible frame, the substantially horizontal component being cushioned substantially along a length thereof to accommodate a back of a user's ankles and to protect the user's Achilles tendons.

5. The exercise apparatus according to claim 4, wherein the foot anchor is mounted telescopically with respect to the extended vertical bar of the collapsible frame.

6. The exercise apparatus according to claim 5, wherein the foot anchor comprises a rectangular hollow section, permanently affixed to the upper end of the extended vertical bar of the collapsible frame; a spring loaded pull pin connected to a base and fixed to the rectangular hollow section; a smaller rectangular section located inside the rectangular hollow section and with a series of holes to allow for foot anchor telescopic height adjustments with respect to the spring-loaded pull pin; a hollow cylindrical tubular section connected at a right angle at an upper end thereof to the smaller rectangular section, projecting outwards equally on opposite sides of the smaller rectangular section, said hollow cylindrical tubular section being covered along an exposed length thereof with foam rollers, wherein exposed ends of hollow sections of the foot anchor are fitted with plastic caps.

7. The exercise apparatus according to claim 1 wherein the collapsible frame is made of tubular or box steel.

8. The exercise apparatus according to claim 1 wherein the collapsible frame extends substantially beyond a lower end of the kneeling pad.

9. The exercise apparatus according to claim 1 wherein the collapsible frame is length adjustable.

10. The exercise apparatus according to claim 9, wherein the main support bar is formed from two pieces, one fitting telescopically within the other, such that the main support bar may be collapsed in length to facilitate ease of storage.

11. The exercise apparatus according to claim 1 wherein the collapsible frame is height adjustable.

12. The exercise apparatus of claim 1 wherein side bars extend from the main support bar to provide a platform specifically for the kneeling pad.

13. The exercise apparatus according to claim 1 wherein feet of the exercise apparatus have high grip surfaces to ensure stability of the exercise apparatus in use on any floor.

14. The exercise apparatus according to claim 1 wherein the foot anchor is fitted with a resistance spring.

15. The exercise apparatus according to claim 1 wherein the exercise apparatus further comprises hollow sections with exposed ends, and wherein the exposed ends of hollow sections are fitted with plastic caps.

16. The exercise apparatus according to claim 1 wherein the extended vertical bar is connected to the main support bar by a hinged connector which may be releasably bolted to secure the extended vertical bar substantially perpendicular to the main support bar, and which when released allows the extended vertical bar to fold in, parallel to the main support bar so as to facilitate ease of storage.

17. The exercise apparatus according to claim 1, wherein the upper face of the kneeling pad is inclined between 5 degrees and 10 degrees with respect to the horizontal orientation relative to the surface.

18. The exercise apparatus according to claim 1, wherein the upper face of the kneeling pad is inclined between 8 degrees and 10 degrees with respect to the horizontal orientation relative to the surface.

* * * * *